United States Patent [19]

Logue et al.

[11] 4,323,196

[45] Apr. 6, 1982

[54] PAINT SPRAYING APPARATUS

[76] Inventors: Gerald W. Logue, 3566 Aldous Ave. S., Salem, Oreg. 97302; Rudolph R. Schnepel, 4596 Thrush Dr. NE., Salem, Oreg. 97301

[21] Appl. No.: 123,658

[22] Filed: Feb. 22, 1980

[51] Int. Cl.[3] ..... B05B 15/08; B08B 3/02

[52] U.S. Cl. ..... 239/532; 222/174; 239/587

[58] Field of Search ..... 239/525, 532, 587; 222/174, 533

[56] References Cited

U.S. PATENT DOCUMENTS

| | | | |
|---|---|---|---|
| 299,096 | 5/1884 | Winter | 222/174 |
| 550,040 | 11/1895 | Busha | 239/587 X |
| 682,736 | 9/1901 | Owen | 222/174 |
| 1,511,361 | 10/1924 | Paasche | 239/532 X |
| 2,574,206 | 11/1951 | Browning | 239/227 X |
| 3,420,444 | 1/1969 | Avnefors | 239/227 |
| 3,915,382 | 10/1975 | Davis | 239/532 X |
| 3,940,072 | 2/1976 | Ishikawa et al. | 239/587 |
| 4,023,711 | 5/1977 | Sena | 222/174 |

FOREIGN PATENT DOCUMENTS

| | | | |
|---|---|---|---|
| 2304738 | 8/1974 | Fed. Rep. of Germany | 239/587 |
| 605214 | 9/1978 | Switzerland | 239/532 |

*Primary Examiner*—Andres Kashnikow

*Attorney, Agent, or Firm*—Kolisch, Hartwell & Dickinson

[57] ABSTRACT

In spraying apparatus for discharging fluid under pressure including an elongate tube having a nozzle pivotally mounted adjacent one end thereof and a handle mounted adjacent the other end operable for delivering fluid under pressure from a source through the elongate tube and the nozzle, an improved attachment includes an orienting device mounted adjacent the handle and coupled to the nozzle which is operable for selectively positioning the nozzle, relative to the elongate tube, about a pivot axis extending generally transversely to the longitudinal axis of the elongate tube. The orienting device includes a manually operable rotatable member and a cable coupling the rotatable member to the nozzle for transferring rotational action from the rotatable member, upon rotation thereof, to the nozzle.

4 Claims, 6 Drawing Figures

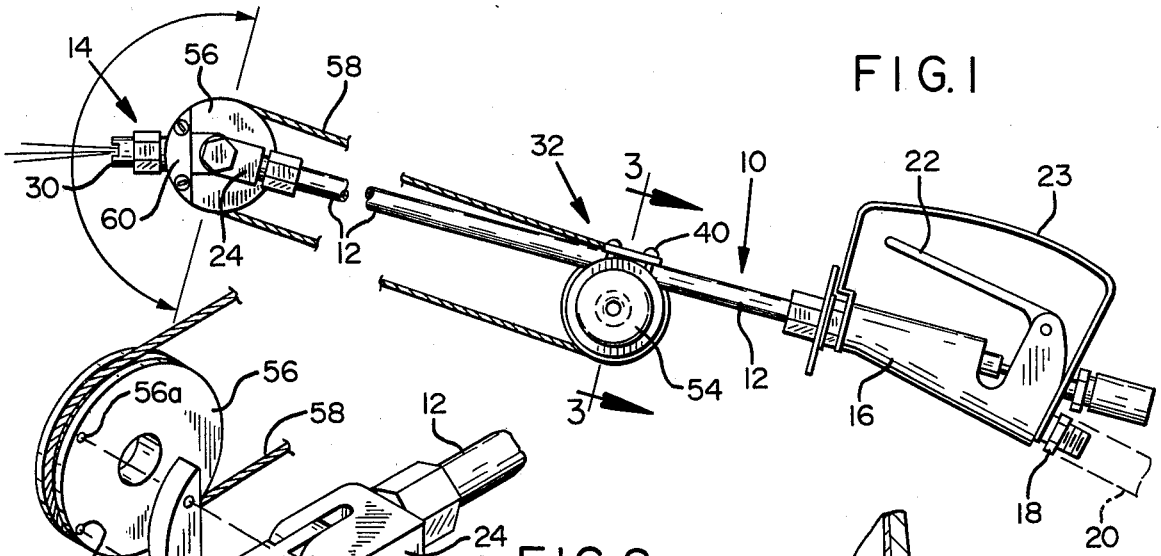
FIG. 1
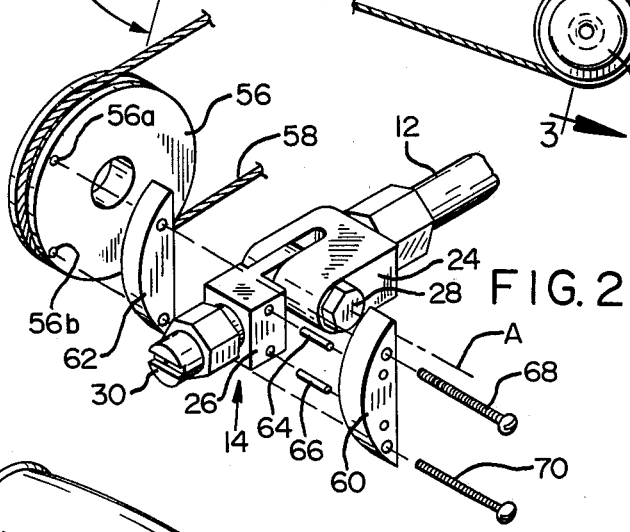
FIG. 2
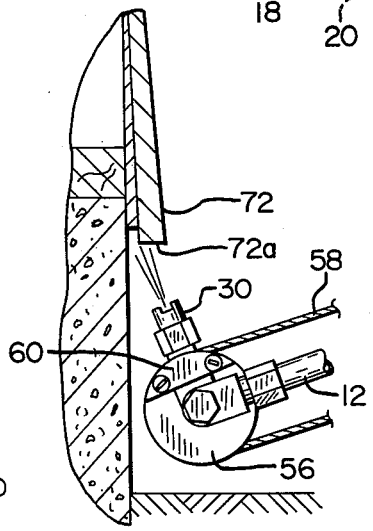
FIG. 5
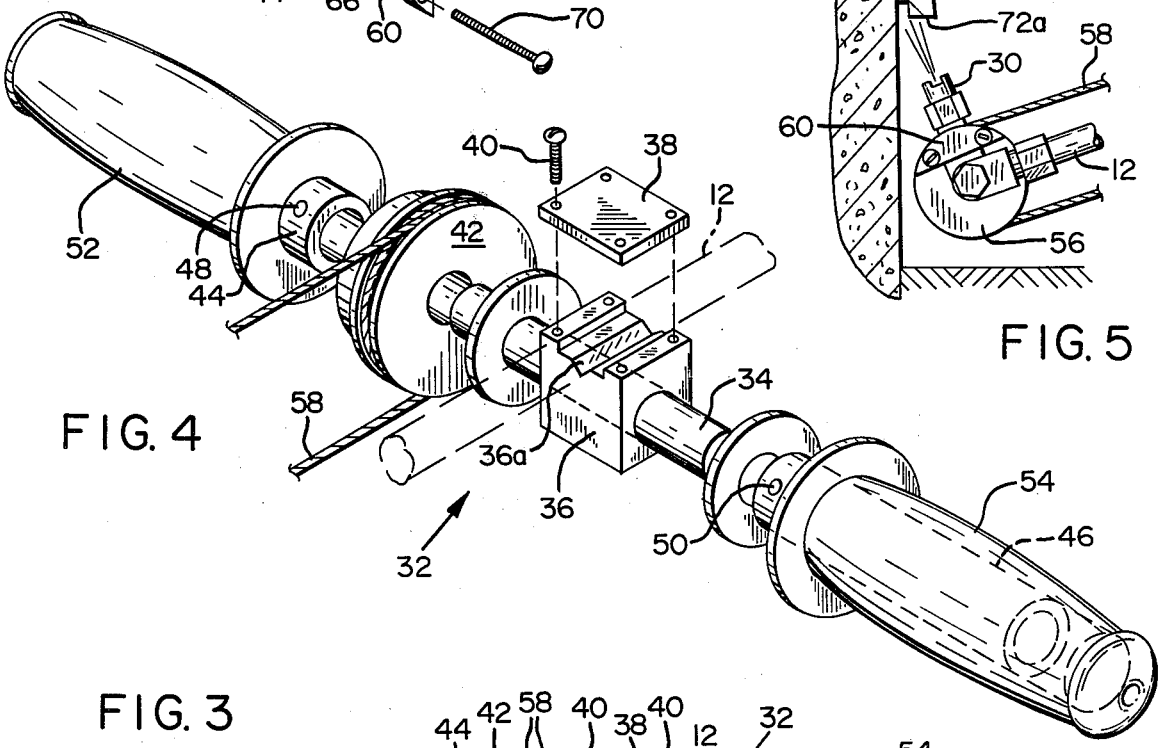
FIG. 4
FIG. 3
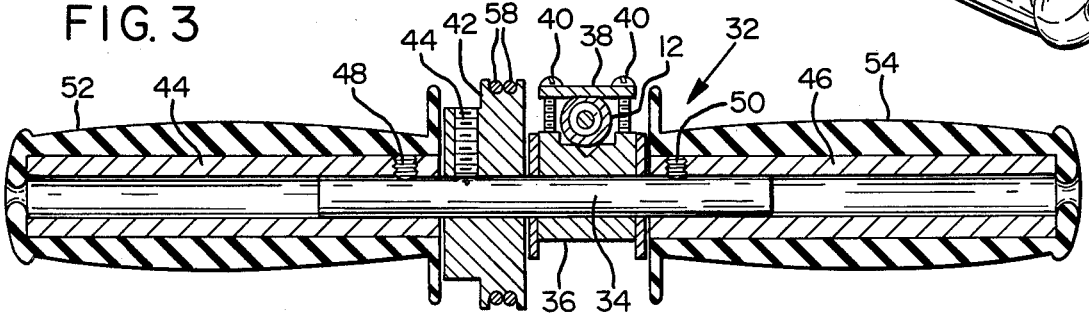

PAINT SPRAYING APPARATUS

BACKGROUND AND SUMMARY OF THE INVENTION

The present invention relates to spraying apparatus for use by painters, and more particularly to a novel attachment for use with a spray pole gun which permits selective manual pivoting of a spray nozzle mounted at the end of the pole.

In the commercial painting industry, it has been found particularly advantageous to utilize so-called pole guns for painting exterior and interior wall surfaces of homes, buildings, large storage tanks, etc. Pole guns generally include some type of paint conducting elongate tube having a spray nozzle mounted at one end thereof. Mounted adjacent the opposite end is a handle provided with a controllable valve operable for selectively metering paint, under pressure, from a pumping source through the elongate tube for discharge from the spray nozzle. Such pole guns are manufactured with elongate tubes in various lengths so that a painter may stand on a floor surface and suitably position the spray nozzle at some high or difficult to reach area to be painted. Use of a pole gun as described may eliminate the requirement of ladders and the time necessary to position ladders, scaffolding or the like.

It has also been found advantageous to provide a spray nozzle at the end of the elongate tube which may be pivoted about an axis extending generally transversely to the longitudinal axis of the elongate tube. However, prior art spray pole guns generally utilize spray nozzles which are pivotally mounted to the elongate tube by means of a clamp or set screw. Thus, if a painter seeks to adjust the angular position of the spray nozzle relative to the elongate tube, the painter must lower the elongate tube so that the spray nozzle is adjacent his hands in order to provide the necessary adjustment. This is particularly disadvantageous when it is realized that a painter will extend the elongate tube, apply paint by manipulation of the controllable valve, and then must return the elongate tube with the spray nozzle adjacent his hands in order to adjust the spray nozzle.

If the elongate tube is of substantial length, it can be appreciated that the painter must constantly be extending the elongate tube, and then depending upon an area to be painted, must return the tube adjacent the floor surface for adjusting the angle of the spray nozzle as required. This repetitive chore becomes time consuming and wearisome because it involves extending the pole gun, returning same for spray nozzle adjustment, etc. Considerable downtime in actual paint application is the result.

A typical example of a spray gun suffering from the above-described deficiencies is disclosed in Davis, U.S. Pat. No. 3,915,382, which describes an extension spray gun having a telescopically extendible pole with a spray nozzle secured to one end thereof. The spray nozzle is pivotally mounted to the end of the spray pole but includes a fastener in the form of a wing nut which must be manually loosened and re-tightened in order to adjust the requisite angularity of the spray nozzle relative to the pole. Another similarly defective example of a spraying device utilizing a pole and nozzle is Paasche, U.S. Pat. No. 1,511,361. That patent also discloses an elongate pole having a nozzle which may be selectively adjusted but only after the pole is returned from an extended position so that a painter may manually loosen a clamping nut, provide the necessary adjustment, and then tighten the nut.

Accordingly, it is a general object of the present invention to provide a spraying apparatus, utilizing an elongate tube having a spray nozzle pivotally mounted adjacent one end thereof and a handle mounted adjacent the other end with an improvement including an attachment or orienting means mounted adjacent the handle operable by the painter for selectively positioning the spray nozzle, relative to the elongate tube, about a pivot axis extending generally perpendicularly to the longitudinal axis of the elongate tube. With the orienting means mounted adjacent the handle, it can be readily appreciated that a painter may position the spray nozzle adjacent some distant location for spraying action and then, without returning the nozzle adjacent to the painter, may selectively position the nozzle to effect a desired angular position for suitable spraying action.

Another object of the present invention is to provide a spraying apparatus, as described above, wherein the orienting means includes a rotatable member for gripping by the painter coupled by an elongate means, such as a cable, to the spray nozzle for transferring rotational action from the rotational member to the spray nozzle.

Still another object of the present invention is to provide a first pulley means connected to the rotatable member and rotatable therewith which is interconnected by the cable to a second pulley means connected to the spray nozzle. Thus, upon rotation of the rotatable member by a painter, the first pulley means transfers this action through the cable means to the second pulley means which, in turn, rotates the spray nozzle to a selected position.

These and additional objects and advantages of the present invention will be more readily understood after a consideration of the drawings and the following detailed description of the preferred embodiment.

BRIEF DESCRIPTION OF THE DRAWINGS

FIG. 1 is a side elevation view of a pole gun, broken along its length, illustrating mounting of the attachment or orienting means of the present invention;

FIG. 2 is an enlarged view of the spray nozzle portion of the pole gun illustrating, in exploded view, a pulley for mounting adjacent the spray nozzle;

FIG. 3 is a cross-sectional view taken along lines 3—3 of FIG. 1;

FIG. 4 is an exploded view similar to that shown in FIG. 3;

FIG. 5 is a side elevation view, of a portion of a pole gun, utilizing the attachment of the present invention illustrating the manner in which difficult to reach areas may be advantageously painted.

DETAILED DESCRIPTION OF THE PREFERRED EMBODIMENT

Figure 6:
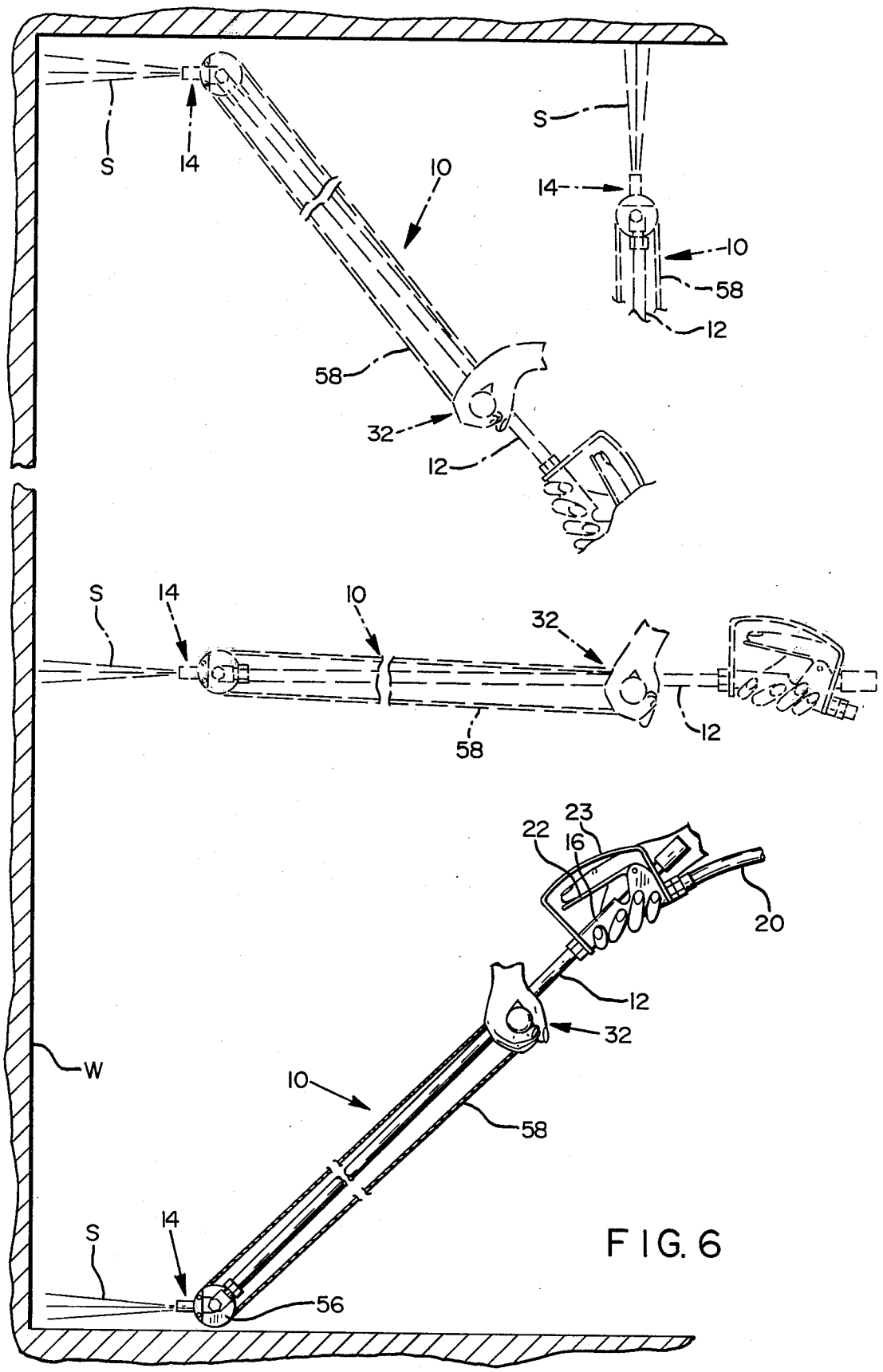
FIG. 6 is a side view illustrating in sequence operation of a pole gun utilizing the present invention for application of paint to vertical and horizontal wall surfaces.

As mentioned previously, the present invention is directed to providing an attachment, hereinafter referred to as an orienting means, to a spray gun of the "pole gun" type for facilitating selective, remote positioning of the spray nozzle on the pole gun during painting. Turning now to FIG. 1 of the drawings, a pole gun is generally indicated at 10. Conventional features of the pole gun include an elongate paint conducting tube 12 provided with a spray nozzle 14 pivotally mounted adjacent one end thereof and a handle 16 mounted adjacent the other end. Handle 16 includes a fitting 18 for receiving a paint hose 20 which, in turn, is connected to a source of paint under pressure. Additionally, it can be seen that handle 16 includes an actuating lever 22 for controlling a paint introduction valve for manipulation by a painter for selectively permitting paint, under pressure, to be conducted through the handle, elongate tube 12, for eventual discharge from nozzle 14. A hand guard is provided as indicated at 23.

Additional features of nozzle 14 may be seen from a consideration of FIG. 2. For instance, nozzle 14 includes a head 24 to which a swivel 26 is pivotally connected. The swivel is pivotally connected to head 24 for pivoting about a pivot axis A defined by a bolt or plug 28. A port extends from elongate tube 12 through head 24, plug 28, and through swivel 26 for discharge through a spray tip 30. While not specifically illustrated, a locking or set screw is conventionally provided on the other side of head 24 for engaging and locking the position of swivel 26 at some predetermined orientation. Thus far, pole gun 10 as described is entirely conventional. What the present invention is directed to is an attachment for mounting on the pole gun which will be referred to generally as an orienting means for selectively swinging or pivoting swivel 26, and spray tip 30 by a painter. Control of the pivoting will be from a position remote from the nozzle as will become apparent.

An orienting means, in accordance with the present invention, is generally indicated at 32 in FIG. 1 and includes a manually rotatable member mounted adjacent handle 16 coupled to nozzle 14 and operable for selectively positioning the nozzle, relative to elongate tube 12, about pivot axis A which extends generally transversely to the longitudinal axis of the elongate tube. As shown in FIG. 4, in exploded view, orienting means 32 includes a rotatable member 34 which is rotatably journaled within a block member 36. The block member includes a recessed portion 36*a* for receiving tube 12 so that the tube nests thereon. A clamping plate 38 is suitably positioned against an opposed portion of tube 12 and is secured to block member 36 by screws indicated at 40, so that the elongate tube is securely clamped to the block member.

As shown in FIG. 3, a first pulley means 42 is mounted on rotatable member 34 by means of a set screw 44. Concentrically received over opposite end portions of rotatable member 34 are support tubes 44, 46 secured to elongate member by suitable clamping or set screws 48, 50. Support members 44, 46 provide a suitable elongate mount for hand grips 52, 54, respectively. Thus, it can be seen that upon manual rotation of elongate member 34, by suitably gripping one of hand grips 52, 54, rotation will be imparted to first pulley means 42, and by suitable coupling to swivel 26, will thereby rotate the swivel in a manner to be described.

Returning now to FIG. 2, attention is directed to the provision of a second pulley means 56 mounted to spray nozzle 14, and more particularly to swivel 26, which is coupled to first pulley means 42. Explaining further, first pulley means 42 is coupled to second pulley means 56 by a cable means such as wire cable 58. FIG. 2 is an exploded view illustrating assembly of second pulley means 56 to swivel 26. The second pulley means is to be mounted on swivel 26 so that the rotational axis of the pulley means is substantially aligned along pivot axis A. To enable such a mounting, arcuate clamping members 60, 62 are provided with arcuate portions dimensioned with an arc coinciding with the arc determined by the radius of second pulley means 56. The clamping members are to be suitably clamped to swivel 26 and to this end, guide pins, such as indicated at 64, 66 are inserted into aligned bores in the swivel as well as aligned bores in clamping member 60. Elongate screws such as indicated at 68, 70 are inserted through aligned receiving bores in clamping members 60, 62, as shown and are threadably secured within aligned threaded bores provided in second pulley means 56. The threaded bores in second pulley means 56 are indicated at 56*a*, 56*b*. Thus, with screws 68, 70 suitably inserted through clamping members 60, 62 and secured to second pulley means 56, the second pulley means will be clamped to swivel 26.

As mentioned above, second pulley means 56 is mounted on swivel 26 to that the central or rotational axis of the pulley is substantially aligned along pivot axis A. Stated differently, the circumference of second pulley means 56 is defined by a central axis aligned with pivot axis A. Rounding out a description of the first and second pulley means, it can be seen that cable 58 is trained on each pulley means for transferring motion from first pulley means 42 to second pulley means 56 upon suitable rotation of elongate member 34. Additionally, it can be seen that in order to provide adequate frictional engagement between cable 58 and the pulley means, a double wrap of the cable is taken in the groove of each pulley means.

The use of a pole gun provided with the attachment or orienting means of the present invention will now be described with particular reference being directed to FIG. 6. In painting of wall surfaces, such as a vertical wall, it is preferable to maintain the nozzle tip of a pole gun at an approximate, predetermined distance from the surface to be painted. This is usually necessary in order to ensure even distribution of paint. Considering FIG. 6, there is shown a vertical wall surface indicated at W which is to be provided with an even application of paint. As shown in the bottom portion of FIG. 6, a painter is beginning painting of wall W at a bottom portion thereon. By suitably gripping handle 16 with, for instance, the painter's right hand, and handgrip 54 with the left hand, nozzle 14 may be suitably positioned so as to direct paint in form of spray, indicated at S, in a generally perpendicular direction toward the wall.

As the painter progresses upwardly along wall W, it is necessary for the painter only to pivot elongate tube 12 about rotatable member 34. Because an elongate tube is used, it will be assumed, at least for purposes of description, that the painter need not change forward position relative to the wall. The painter may efficiently achieve remote pivoting of the nozzle to maintain predetermined spacing thereof from the wall by moving handle 16 downwardly while keeping the relative orientation of the left hand somewhat constant. Because rotatable member 34 is rotatable relative to elongate tube 12, and because relative pivoting between the elongate member and elongate tube 12 will result in pivoting of nozzle 14, the nozzle will pivot relative to the elongate tube so as to direct paint spray S toward the wall as shown in the phantom line position illustrated in the middle portion of FIG. 6. As the painter works further up wall W to the position shown at the top of the wall, it can be seen that by downwardly pivoting handle 16, relative to elongate member 34, nozzle 14 will still be directed generally perpendicularly to the wall surface. As shown in the upper right of FIG. 6, the painter has directed pole gun 10 to paint the ceiling.

While one method of paint application has been described with reference to FIG. 6, it can be appreciated that the present invention permits a painter to continuously orient or position nozzle 14 relative to a surface to be painted by rotating elongate member 34 relative to elongate tube 12 which in turn rotates first pulley means 42 and transfers rotation to second pulley means 56. A painter may selectively position the spray nozzle relative to the elongate tube without having to lower the pole gun and manually reset the spray nozzle to some predetermined orientation. As shown in FIG. 1, use of the orienting means of the present invention will readily permit spray nozzle 14 to be selectively and remotely swung along an arc controlled by an operator adjacent handle 16.

The advantageous uses of such a selectively and remotely positionable spray nozzle are many. While one has been described with reference to a wall surface shown in FIG. 6, it can be appreciated that ready adjustability of a spray nozzle will find particular application on large storage vessels which may have nonlinear peripheral dimensions. By constructing the pole gun of sufficient length to reach the top of such a vessel, and providing an orienting means as aforedescribed, precise painting may be effected on the tank with the painter never having to repetitively lower the pole for resetting the spray nozzle. Rather, the spray nozzle may be continuously and sequentially adjusted as needs dictate in the "remote" manner detailed above.

Another advantage of providing a selectively adjustable spray nozzle is illustrated in FIG. 5. More particularly, it has heretofore been difficult to paint low portions of buildings having lap siding and in particular bottom edges of the siding members. For instance, as shown in FIG. 5, a piece of lap siding 72 has a lower surface 72*a* which is to be painted. By providing a pole gun with the orienting means of the present invention, it can be appreciated that the spray nozzle may be suitably positioned to reach surface 72*a* and apply paint as shown.

Further, it is to be appreciated that the orienting means of the present invention is extremely simple in construction and may readily be attached to existing pole guns to convert or retrofit same to provide an automatically adjustable spray nozzle. It is only necessary to mount first pulley means 42 as shown in FIGS. 3 and 4 to tube 12 by suitably clamping block member 34 to the tube by means of clamping plate 38 and the associated screws. As shown in FIG. 2, it is a simple matter to mount second pulley means 56 to swivel 26 with cable 58 being trained over the first and second pulley means. Of course the length of cable 58 is dependent upon the length of the pole gun. The only additional modification which may have to be made is the loosening of a set screw which may be provided in conventional pole guns to fix the position of swivel 26 relative to elongate tube 12. It is necessary to remove this set screw so that the automatic adjustability of the orienting means of the present invention may be employed.

While the present invention has been described with reference to the foregoing preferred embodiment, it will be understood by those skilled in the art that other changes in form and detail may be made within the spirit and scope of the invention as defined in the appended claims.

It is claimed and desired to secure by letters patent:

1. In spraying apparatus for discharging fluid under pressure including an elongate tube having a nozzle pivotally mounted adjacent one end thereof and a handle mounted adjacent the other end operable for delivering fluid under pressure from a source through the elongate tube and the nozzle, the improvement comprising:

orienting means including a manually rotatable member mounted adjacent the handle operable for rotation about an axis extending generally transversely to the longitudinal axis of the elongate tube and coupled to the nozzle operable for selectively pivoting the nozzle, relative to the elongate tube, about a nozzle pivot axis extending generally transversely to the longitudinal axis of the elongate tube;

a block member detachably clamped to the elongate tube adjacent the handle for rotatably journalling said rotatable member;

first pulley means concentrically mounted on said rotatable member and second pulley means connected to the nozzle, said first and second pulley means being interconnected by a cable means trained on each pulley means, said second pulley means being detachably mounted on the nozzle; and clamping members clamped on the nozzle for providing a mount for said second pulley means.

2. The spraying apparatus of claim 1 wherein said clamping members include a pair of members clamped on opposite sides of the nozzle, each clamping member being formed with an arcuate portion dimensioned with an arc generally coinciding with the arc determined by the radius of said second pulley means.

3. The spraying apparatus of claim 2 wherein said second pulley means is defined by a central axis substantially aligned with the pivot axis of the nozzle.

4. The spraying apparatus of claim 3 wherein said second pulley means is secured to the nozzle.

* * * * *